US011223886B1

(12) United States Patent
Fadul et al.

(10) Patent No.: US 11,223,886 B1
(45) Date of Patent: Jan. 11, 2022

(54) VEHICLE MOUNTED SOUND BAR AND OPERATION THEREOF

(71) Applicant: Grace Digital, Inc., San Diego, CA (US)

(72) Inventors: Greg William Fadul, San Diego, CA (US); James D. Palmer, San Diego, CA (US); Jonathan Jay Lorenzen, San Diego, CA (US)

(73) Assignee: GRACE DIGITAL, INC., San Diego, CA (US)

( * ) Notice: Subject to any disclaimer, the term of this patent is extended or adjusted under 35 U.S.C. 154(b) by 0 days.

(21) Appl. No.: 17/084,497

(22) Filed: Oct. 29, 2020

(51) Int. Cl.
*H04R 1/02* (2006.01)

(52) U.S. Cl.
CPC ..... *H04R 1/025* (2013.01); *H04R 2499/13* (2013.01)

(58) Field of Classification Search
CPC ..... H04R 1/025; H04R 2499/15
See application file for complete search history.

(56) References Cited

U.S. PATENT DOCUMENTS 4,756,382 A * 7/1988 Hudson, III ..... H04R 1/227 181/141
5,191,177 A 3/1993 Chi
5,664,020 A * 9/1997 Goldfarb ..... H04R 1/02 181/196
8,201,659 B2 * 6/2012 Imai ..... H04R 1/2811 181/146
8,948,437 B2 2/2015 Paye
9,462,361 B2 * 10/2016 Amae ..... H04R 1/02
9,469,254 B1 10/2016 White et al.
10,471,903 B1 * 11/2019 Jordan ..... H04R 1/403
2008/0141924 A1 6/2008 Adams
2014/0029782 A1 * 1/2014 Rayner ..... H04R 3/00 381/386
2019/0281374 A1 * 9/2019 Proni ..... H04R 1/028
2020/0196038 A1 * 6/2020 Curtiss ..... H04R 9/022

* cited by examiner

*Primary Examiner* — Jason R Kurr
(74) *Attorney, Agent, or Firm* — Kerr IP Group, LLC

(57) ABSTRACT

A sound bar system and method of use are disclosed. The sound bar system, in various embodiments, includes a tubular hollow housing, two woofers, two speaker assemblies, and two baffles. The tubular hollow housing includes two terminal circular openings, one at each end of the tubular hollow housing, and an interior passage that extends between the two terminal circular openings. Each terminal circular opening receives one of the woofers. The tubular hollow housing also includes two speaker assembly openings that each extend from an outer surface of the tubular hollow housing to the interior passage. Each speaker assembly opening receives one of the speaker assemblies. The baffles are located inside the interior passage, such that the baffles divide the interior passage into three isolated sound spaces. One sound space houses one woofer and one speaker assembly. Another sound space houses another woofer and another speaker assembly. The last sound space is located in between the other two sound spaces.

15 Claims, 6 Drawing Sheets

VEHICLE MOUNTED SOUND BAR AND OPERATION THEREOF

FIELD

The present disclosure relates to sound bar systems and methods of operating such. More particularly, the present disclosure relates to a sound bar adapted for outdoor use and mounting on a vehicle.

BACKGROUND

A variety of systems for housing, amplifying, mounting, and protecting one or more speakers have been developed. Initially, these systems were designed specifically for indoor use and maximizing the user's experience in a home setting. In particular, the cabinets or other structures containing speakers were composed of wood and/or cardboard, and organized to emit and disperse sound to reflect off of nearby walls and ceilings back toward a listener. One such structure that is especially effective for dispersing sound is a tube. This structure is so effective that it has been used as a stand-alone element for both indoor and outdoor speaker systems, and known as a "sound bar."

However, successfully adapting a sound bar for attachment to various recreational land vehicles, particularly off-road vehicles such as an ATV, dune buggies and similar land vehicles, as well as marine vessels such as ski boats, off-shore recreational fishing boats, party barges and similar watercraft, requires overcoming various problems unique to these land vehicles and watercraft. Sound systems for such vehicles must (1) be impact resistant; (2) provide durable attachment to the vehicle; (3) this durable attachment must also be versatile to allow for quick and simple adjustments to the position and/or directionality of the speakers to accommodate changes in the listening environment; and (4) protect the electrical components of the speakers from dirt, dust, mud, and/or water.

U.S. Pat. No. 5,191,177 was an early attempt to provide a stable, convenient speaker system for an automobile requiring minimal alteration to the vehicle. This speaker system's convenience relied on the presence of a flat surface within the vehicle for the system to rest upon. Since this system merely rested upon a flat surface within the vehicle, it was limited to on-road trucks and cars, but not suitable to off-road vehicles or watercraft that travel over bumpy terrain such as dusty/muddy trails and choppy water. Such off-road and over-water travel submit sound systems to vigorous physical shaking and jolting requiring very secure attachment to the vehicle or watercraft, as well as construction that could withstand significant mechanical impact. Additionally, this speaker system was constructed from cardboard, further limiting its use to an enclosed interior location of a vehicle as it would not withstand prolonged or repeated exposure to dirt, dust, mud, rain, and/or splashed water, such as from waves, wakes or wet passengers.

U.S. Patent Publication 2008/0141924 presented an alternative speaker assembly especially adapted for use on watercraft. This system solved the problem of water exposure and impact durability by mounting speakers within retractable housings. However, these housings require substantial modification of the watercraft and provide only directional sound aimed rearward toward individuals towed behind the watercraft.

U.S. Pat. No. 8,948,437 improved upon the speaker systems for watercraft by providing vertically oriented sound rods of a stainless steel construction that provide 360° sound in an approximately horizontal plane. However, the mounting system employed is limited to watercraft, and particularly watercraft with existing fishing rod holders that can receive the mounting pole of the sound rod.

U.S. Pat. No. 9,469,254 provided a more versatile mounted speaker system for off-road vehicles, ATVs, UTVs, watercraft, and motorcycles that employs an L-shaped mounting bracket to attach an array of speakers to such vehicles. The L-shaped mounting bracket enables rotation of the speaker array 360° about the plane in which the array is mounted. However, the orientation of the speaker array limits sound dispersion from any given orientation (i.e., rotational position) of the array to a single direction. The speaker system also includes a housing encasing the backside of the array of speakers, but does not utilize any sound chamber(s) to amplify, disperse, or direct the sound produced by the speakers of the array.

U.S. Pat. No. 10,471,903 provided a similarly versatile mounted sound bar for off-road vehicles and watercraft that improved the distribution of emitted sound through the tubular structure of the sound bar. However, this sound bar relied upon a singular, enclosed internal sound space to reverberate the sound waves produced by the speakers housed in the sound bar and seal the speakers off from the dust, dirt, mud, and water encountered during use. However, this orientation creates significant stress on the speakers and sound bar structure, requiring the reverberations to be equal and opposite in order to cancel one another out.

Although such prior art devices have addressed some of the prior art problems, there remains a need in the industry for an easily and durably mounted speaker system that provides directional adjustable multi-range sound that operates in the dusty, dirty, muddy, and wet conditions encountered by off-road vehicles and watercraft that better reduces or eliminates prior art problems.

SUMMARY

A sound bar system and method of use are described herein. The sound bar system includes a tubular hollow housing, a first woofer speaker, a second woofer speaker, a first speaker assembly, a second speaker assembly, a first baffle, and a second baffle. The tubular hollow housing includes a first terminal circular opening, a second terminal circular opening at the end of the tubular hollow housing opposite the first terminal circular opening, an interior passage extending between the first and second terminal circular openings, an outer tubular surface extending the length of the tubular hollow housing from the first terminal circular opening to the second terminal circular opening that encapsulates and surrounds the interior passage, a first speaker assembly opening extending from the tubular surface to the interior passage, a second speaker assembly opening extending from the tubular surface to the interior passage, and a plurality of membranes coupled with the tubular surface and the interior passage.

The first woofer speaker is received by the first terminal circular opening of the hollow housing. The second woofer speaker is received by the second terminal circular opening of the hollow housing. The first speaker assembly is received by the first speaker assembly opening of the hollow housing. The second speaker assembly is received by the second speaker assembly opening of the hollow housing. The first baffle is located within the tubular hollow housing in the interior passage more proximate to the first terminal circular opening than the second terminal circular opening. The second baffle is located within the tubular hollow housing in the interior passage more proximate to the second terminal circular opening than the first terminal circular opening.

The first baffle and the second baffle are oriented so that they separate the interior passage of the tubular hollow housing into a first internal sound space, a second internal sound space, and a third internal sound space. The first internal sound space includes the first woofer speaker and the first speaker assembly. The second internal sound space includes the second woofer speaker and the second speaker assembly. The third internal sound space is located in between the first internal sound space and the second internal sound space such that the third internal sound space separates and isolates the first internal sound space from the second internal sound space.

In one illustrative embodiment, the sound bar further includes a mounting inlay, a first mounting bracket, and a second mounting bracket. The mounting inlay is affixed to the tubular surface on the exterior of the tubular hollow housing. The first mounting bracket includes a pivot attach point centered on a central lengthwise axis of the tubular hollow housing and is affixed to the mounting inlay at a location proximate to the first terminal circular opening. The second mounting bracket also includes a pivot attach point centered on the central lengthwise axis of the tubular hollow housing and affixed to the mounting inlay at a location proximate to the second terminal circular opening.

In another illustrative embodiment, each of the plurality of membranes is a waterproof mesh material spanning a port extending from the surface of the tubular housing to the interior passage that allows the passage of air through the port.

A method for operating the sound bar is also described. The method operates a sound bar having a tubular hollow housing with a central lengthwise axis, a first terminal circular opening, a second terminal circular opening, an interior passage extending between the first and second terminal circular openings, an outer tubular surface extending the length of the tubular hollow housing from the first terminal circular opening to the second terminal circular opening that encapsulates and surrounds the interior passage, a plurality of membranes coupled with the tubular surface and the interior passage, a first baffle located inside the tubular hollow housing proximate to the first terminal circular opening, and a second baffle located inside the tubular hollow housing proximate to the second terminal circular opening. The first baffle and second baffle separate the interior passage of the tubular hollow housing into a first internal sound space, a second internal sound space, and a third internal sound space. The first internal sound space includes the first woofer speaker, the second internal sound space includes the second woofer speaker, and the third internal sound space is located in between the first and second internal sound spaces.

The method includes emitting first woofer speaker sound waves from the first woofer speaker along the central lengthwise axis distally outward from the first terminal circular opening of the tubular hollow housing in a first direction and emitting the first woofer speaker sound waves proximally into the interior passage of the tubular hollow housing in a second direction. The method also includes emitting second woofer speaker sound waves from the second woofer speaker along the central lengthwise axis of the tubular hollow housing distally outward from the second terminal circular opening in the second direction and proximally into the interior passage in the first direction. The method further includes absorbing the first woofer speaker sound waves emitted proximally into the interior passage of the tubular hollow housing in the second direction with the first baffle, and absorbing the second woofer speaker sound waves emitted proximally into the interior passage of the tubular hollow housing in the first direction with the second baffle. Lastly, the method includes equalizing the internal pressure of the tubular hollow housing with the external pressure surrounding the tubular hollow housing through each of the plurality of membranes.

FIGURES

The present invention will be more fully understood by reference to the following drawings which are presented for illustrative, not limiting, purposes.

DESCRIPTION

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the apparatus and methods described herein may vary as to configuration and as to details. The following detailed description of the illustrative embodiments includes reference to the accompanying drawings, which form a part of this application. The drawings show, by way of illustration, specific embodiments in which the invention may be practiced. It is to be understood that other embodiments may be utilized and structural changes may be made without departing from the scope of the claims.

In various embodiments, the sound bar disclosed herein may include internal baffles within a tubular hollow housing that isolate woofer speakers located at opposite ends of the sound bar from one another. The baffles absorb sound waves and back pressure emitted from the woofer speakers to prevent vibrations from dislodging any speaker from its secured position.

The tubular hollow housing of the sound bar can further include waterproof membranes coupled to the tubular hollow housing that serve the dual purpose of releasing a portion of the back pressure generated by the woofer speakers, as well as, equalizing the internal pressure of the sound bar with the external pressure of the ambient air surrounding the sound bar, while sealing the interior spaces of the sound bar from the outdoor conditions in which the sound bar operates.

In operation, the woofer speakers, mid-range speakers, and tweeter speakers emit sound waves and respective back pressures into internal sound spaces of the sound bar that are created and isolated from one another by the internal baffles.

The internal baffles absorb some or all of these back pressures, thereby maintaining the structural integrity of the sound bar, its components, and the sound quality emitted therefrom. The waterproof membranes on the tubular hollow housing further maintain the structural integrity of the sound bar, its components, and the sound quality emitted therefrom by preventing pressure differentials accumulating between the interior of the sound bar and the exterior of the sound bar due environmental conditions or back pressures emitted from the speakers of the sound bar.

Figure 1:
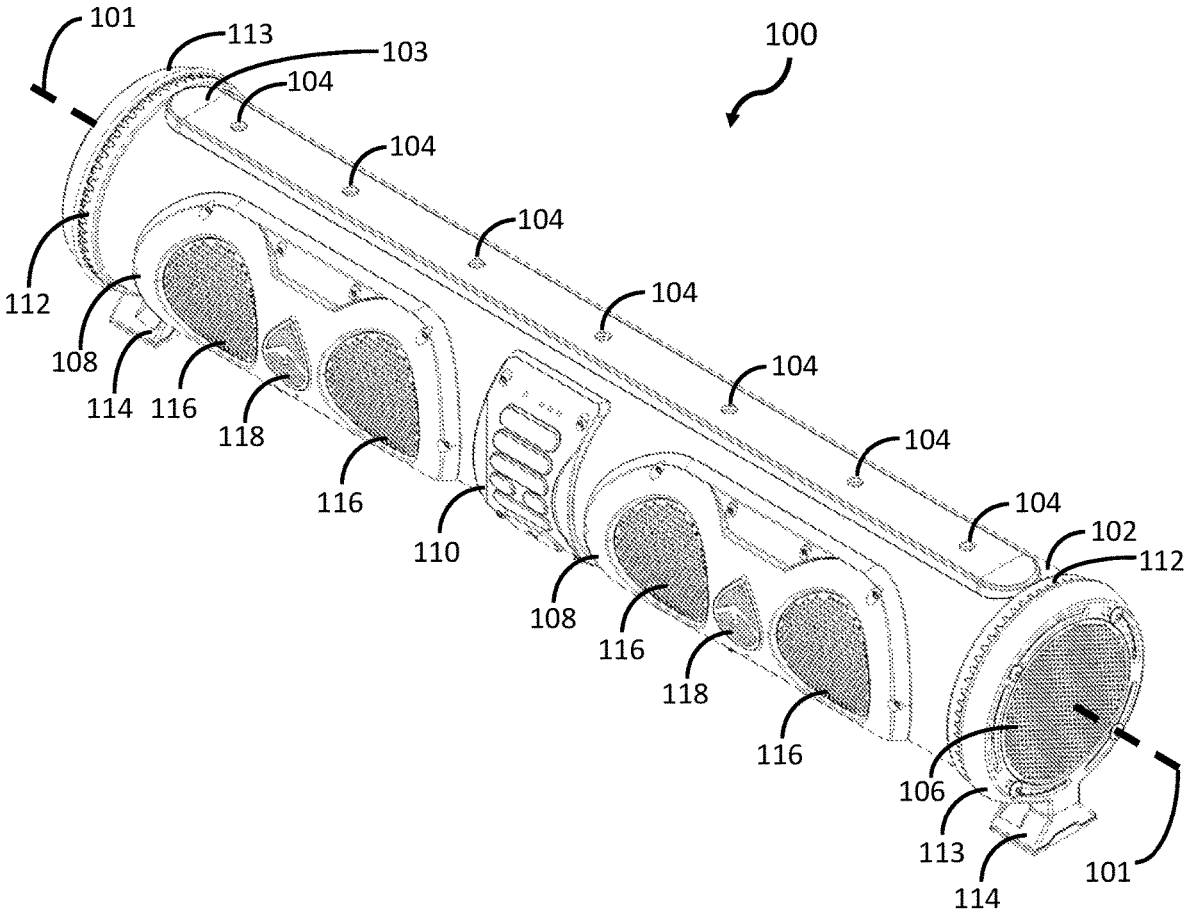
FIG. 1 shows an isometric view of an illustrative sound bar.

Referring to FIG. 1 there is shown an isometric view of an illustrative sound bar 100. In the illustrative embodiment, the sound bar 100 generally includes a central lengthwise axis 101 running through the center of a tubular hollow housing 102. The tubular hollow housing 102 has a first terminal circular opening on one end, a second terminal circular opening on the opposite end, three additional openings along the length of the tubular housing 102, two internal baffles (shown in FIG. 10), a mounting rail 103 aligned linearly along the length of the tubular housing 102, and several female threaded mounting holes 104. The tubular housing 102 is hollow, such that an interior passage (shown in FIG. 10) extends from the first terminal circular opening at a terminal end of the tubular housing 102 to another terminal circular opening at the other terminal end of the tubular housing 102. Similarly, the exterior of the tubular hollow housing 102 includes a tubular surface extending from the first terminal circular opening at a terminal end of the tubular housing 102 to the second terminal circular opening at the other terminal end of the tubular housing 102.

The first terminal circular opening on a first end of the tubular hollow housing receives a first woofer speaker, while the second terminal circular opening on a second end of the tubular hollow housing receives a second woofer speaker. Each woofer speaker is covered by a speaker grill 106.

Two of the openings along the length of the tubular housing 102 receive speaker assemblies 108 of one or more speakers. Thus, these openings are termed the first speaker assembly opening and the second speaker assembly opening. Each speaker may also include an LED light behind a clear plastic speaker driver cone that transmits light from the LED and is also waterproof to protect the speaker components from water damage. The third opening, located between the other two, receives a control panel 110.

Figure 10:
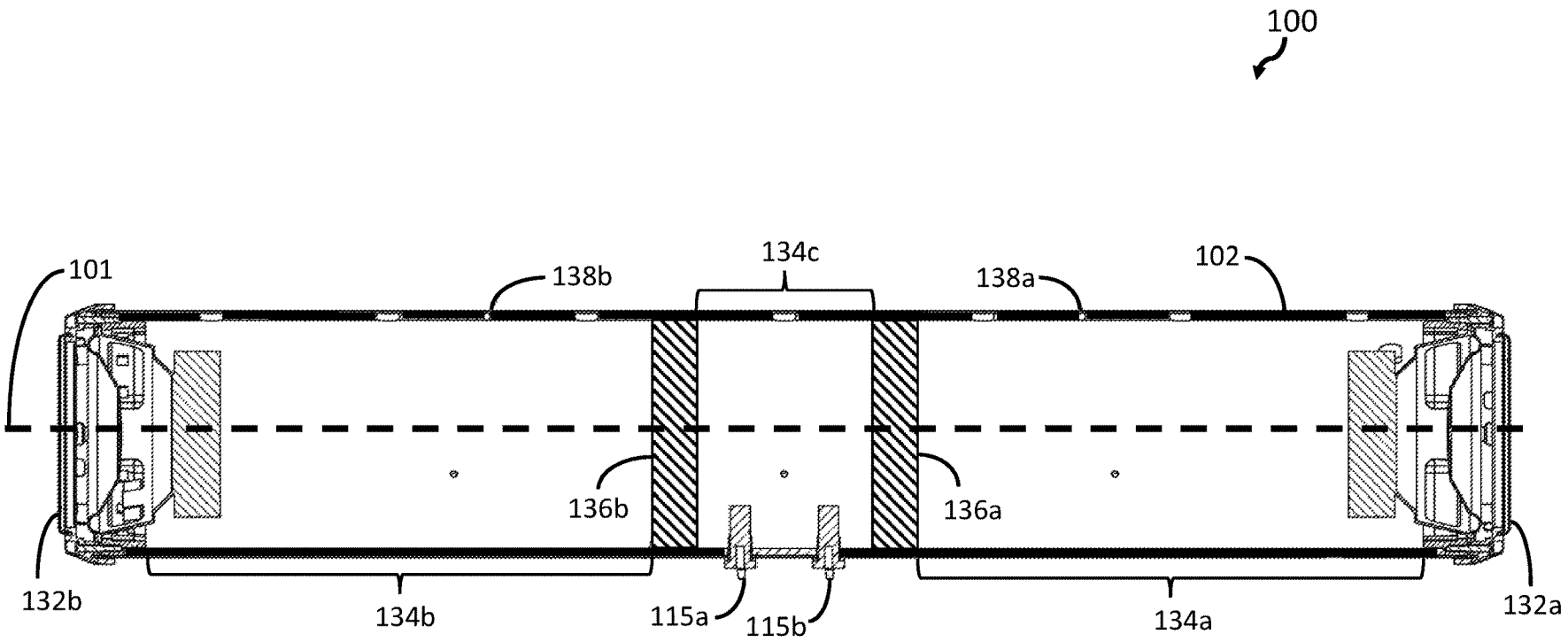
FIG. 10 shows a cutaway view of the interior of the sound bar 100.

Referring to FIG. 10, the internal baffles 136 may include a first baffle and a second baffle, are centrally located within the tubular housing 102, and snugly fit to the size and shape of the interior passage of the tubular housing 102. Each baffle is proximate to and behind one of the woofer speakers, effectively walling off each woofer speaker from the other woofer speaker at the opposite end of the tubular housing 102 and creating three separate sound spaces within the tubular housing 102 interior passage. The three sound spaces are isolated and separate from one another by the central internal baffles. Each woofer speaker is located within or forms part of the border of one of the sound spaces, while the third sound space is located in between the other two sound spaces. The third sound space is located in the center of the interior passage, isolating the control panel 110 from the other two sound spaces and the speakers contained within those sound spaces.

Referring back to FIG. 1, the woofer speakers and speaker grills 106 are secured in place by end frames 112 that are each coupled to a rotation cap 113 that includes mounting legs 114. Together the end frame 112, rotation cap 113, and mounting legs 114 include an end cap assembly. However, the woofer speakers and speaker grills 106 may be independently secured to each other or the tubular housing 102 without requiring any element of the end cap assembly. Although the illustrative speaker grills 106 are traditional metal mesh, the speaker grills 106 may be composed of any suitable material, such as plastic or carbon fiber, and may have any suitable patterning other than the simple repeating array of offset circular holes, such as slots, asymmetric patterning, or patterning resembling images. The illustrative mounting legs 114 provide points of attachment to a surface of a vehicle, such as an ATV or watercraft, and require only two points of contact with the vehicle for attachment. The mounting legs 114 provide an avenue for attachment to a vehicle with fasteners, such as screws, rivets, or pins.

In an alternative embodiment, the rotation caps 113 and mounting legs 114 may not be included in the end cap assembly. Instead, an L-shaped bracket having a pivot point and one or more attachment points may interfaces with the female threaded mounting holes 104 on the mounting rail 103 affixed to the outer surface of the tubular housing 102. Two of these mounting brackets are employed, a first mounting bracket at a first terminal end of the tubular housing 102 and a second mounting bracket at a second terminal end of the tubular housing 102. Each mounting bracket is affixed to the mounting inlay 103 at a location proximate to a respective terminal circular opening of the tubular housing 102. This proximate location is close enough to the terminal circular opening to allow one arm of the L-shaped mounting bracket to extend along the exterior surface of the tubular housing, such that this arm may be affixed to the mounting inlay 103, and to extend beyond the terminal circular opening so that the other arm of the L-shaped bracket may extend perpendicular to the other arm and the tubular housing 102 toward the central lengthwise axis of the tubular hollow housing 102. This positioning of the L-shaped mounting bracket places a first pivot point on the first L-shaped bracket and a second pivot point on the second L-shaped bracket in line with the central lengthwise axis of the tubular housing 102.

The mounting rail 103 may be a mounting inlay formed from metal, a metal alloy, a composite, a plastic, or other suitably durable material that is capable of supporting the weight of the sound bar 100. The attachment points are located on one arm of the L-bracket and enable that arm to be removably connected to the mounting inlay and the tubular housing 102, while the pivot point is located on the other arm of the L-shaped bracket and provides an attachment point to a vehicle or mating bracket thereon. The arm of the L-shaped bracket having the attachment points is affixed parallel to the mounting rail 103 and the length of the tubular housing 102, and the other arm with the pivot point is oriented inward along the radius of the tubular housing 102. The L-shape of these mounting brackets and the pivot point on each allows a sound bar attached thereto to rotate about the pivot point of the first mounting bracket and the second mounting bracket 360°. The length of the arm and location of the pivot point thereon may vary so that the pivot point aligns with a central lengthwise axis of the tubular housing 102. However, the pivot point may be located at a different point of the arm of the L-shaped bracket so that the axis of rotation does not align with the central axis. The pivot point can receive a bolt, pin, or other rotatable fastener that extends through the pivot point and the mating bracket to allow the sound bar 100 to rotate about the pivot point.

In this alternative embodiment, the mounting inlay rail 103 be affixed to the outer surface of the tubular housing 102 with adhesive, waterproof foam, and/or internal fasteners such as screws, rivets, or pins. The combination of adhesive, waterproof foam, and internal fasteners seal the joint between the tubular housing 102 and the mounting inlay. The mounting inlay may include several threaded holes that receive threaded bolts and provide attachment points for the L-shaped bracket(s). The bolts pass through unthreaded clearance holes in the L-shaped brackets and extend into the female threaded mounting holes 104 of the mounting rail 103 to immovably affix the L-shaped brackets to the tubular housing 102. However, the threaded bolts do not extend through the tubular housing 102 into any of the internal sound spaces formed by the baffles.

The speaker assemblies 108 received by the two openings along the length of the tubular housing 102 include multiple speakers to compliment the woofer speakers. The speaker assemblies 108 may cover and protect these speakers with a corresponding speaker grill for each speaker, similar to the speaker grill 106 covering the woofer speakers. Additionally, each speaker in the speaker assembly 108 may be supported and/or affixed to the speaker assembly 108. In the illustrative embodiment, the speaker assemblies 108 include two mid-range speakers 116 on either side of a tweeter speaker 118, i.e. a first mid-range speaker and a second mid-range speaker corresponding to the first speaker assembly surrounding a first tweeter speaker, and a third mid-range speaker and a fourth mid-range speaker corresponding to the second speaker assembly surrounding a send tweeter speaker.

However, the speaker assemblies 108 may include only mid-range speakers 116, only tweeter speakers 118, or other combinations, such as two tweeter speakers 118 and a single mid-range speaker 116, or one each of a mid-range speaker 116 and a tweeter speaker 118. Additionally, the orientation of the speakers within the speaker assembly is not limiting, the single tweeter speaker 118 may be on either side of the two mid-range speakers 116 instead of in between them. Similarly, the alternative embodiments of mid-range speakers 116 and/or tweeter speakers 118 including the speaker assembly 108 may be oriented in a variety of manners, such as a mid-range speaker 116 between two tweeter speakers 118, a tweeter speaker 118 in-board, out-board, stacked above, or stacked below of a mid-range speaker 116, or any combination thereof.

In the illustrative embodiment, the openings along the length of the tubular housing 102 are oriented linearly along a front side of the tubular housing 102 so that the speakers of the speaker assemblies 108 housed within the openings emit sound in the same direction as one another outward from the tubular housing 102 and perpendicular to the central axis 101 of the tubular housing 102.

In alternative embodiments, the openings housing speaker assemblies 108 may not be linearly oriented, but instead be rotated about the surface of the tubular housing 102 so that each speaker assembly 108 emits sound outward from the tubular housing 102 and perpendicular to the central axis 101 of the tubular housing 102, but in different directions from one another.

In one exemplary orientation, one speaker assembly 108 is located on a front side of the tubular housing 102 and another speaker assembly 108 is located on a back side of the tubular housing 102 opposite the speaker assembly 108 located on the front side. However, these exemplary orientations are not limiting, and each opening and speaker assembly 108 may located anywhere on the outer surface of the tubular housing and anywhere relative to the location of the other opening and speaker assembly 108. Additionally, alternative embodiments may include more than just two openings and speaker assemblies 108, such as three, four, or more.

The baffles (shown in FIG. 10) create the separate, isolated sound spaces by snugly fitting to the interior surface of the interior passage within the tubular housing 102 and preventing sound waves from passing from one sound space to a neighboring sound space. The baffles may include a dense foam or other rigid/semi-rigid sound deadening or proofing substances that absorb sound waves. The sound spaces containing a woofer speaker and one or more other speakers act as acoustic-suspension boxes or air-suspension boxes that cause back pressure or sound waves generated by their respective speakers to be directed outward from the sound bar 100. This is especially true for the woofer speakers, which are oriented distally along the tubular housing from the baffles such that the baffles are approximately parallel to the plane the woofer speaker lies within. Thus, the sound waves and/or back pressure generated by each woofer speaker are directed by the corresponding baffle outward from the tubular housing and not internally along the length of the tubular housing between the woofer speakers.

Each speaker of the sound bar 100 is coupled to the control panel 110 that is centered between the additional openings for the speaker assemblies 108 along the length of the tubular housing. The control panel 110 includes a plurality of buttons for controlling operation of the sound bar 100, such as Bluetooth connectivity, speaker volume, sound balance, music controls, and lighting effects.

Figure 2:
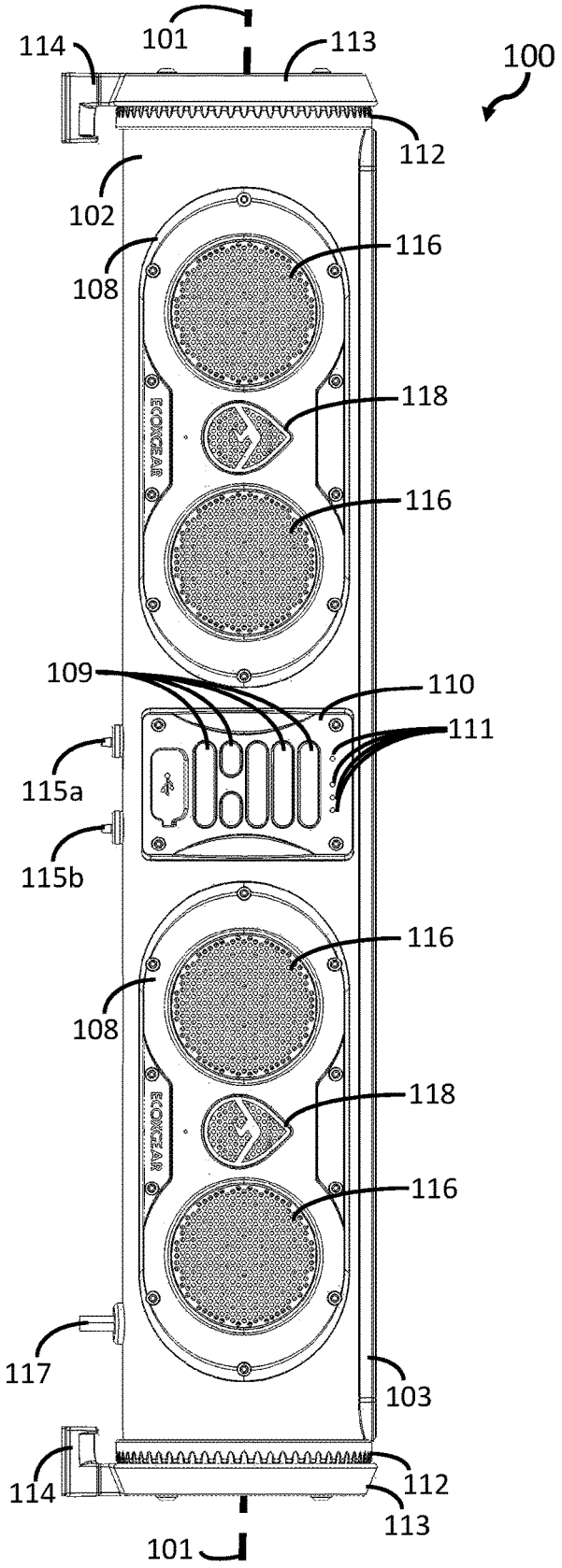
FIG. 2 shows a front view of the illustrative sound bar.

Referring now to FIG. 2, there is shown a front view of the sound bar 100. This view shows the mounting legs 114, auxiliary ports 115*a-b*, and power cable 117 in profile, the control panel 110 in its entirety, and both the speaker assemblies 108 and control panel 110 fastened to the tubular housing 102 with rivets, screws, or bolts. The mounting legs 114 extend outward from the rotation caps 113 to which they are attached perpendicular to the lengthwise central axis of the tubular housing 102 and sound bar 100. The mounting legs 114 expand into a base that is wider than a stem connected directly to the rotation cap 113.

The illustrative control panel 110 is rectangular, centered in the middle of both the length of the tubular housing 102 and the diameter of the tubular housing 102. The buttons 109 of the control panel 110 may receive user input, i.e. be depressed by a user, and thereby operate or engage the various functions and capabilities of the sound bar 100. The control panel includes indicator lights 111 at the top of the control panel 110 that identify operation modes and functions of the sound bar 100, i.e. whether the sound bar 100 is receiving power, whether the battery has a charge, power on/off, receiving radio signal, receiving Wi-Fi signal, receiving Bluetooth signal, or playing music. The control panel 110 is communicatively coupled to each speaker of the sound bar 100, as well as a power source, such as a battery or power from the vehicle to which it is mounted, a processor, a memory, a wireless communication module, the auxiliary ports 115*a-b*, and one or more LED lights embedded in the speakers. Power from an external power source may be received through the power cable 117 and delivered to the control panel 110, processor, memory, wireless communication module, LED lights, and speakers.

The auxiliary ports 115*a-b* may operate as audio input and/or audio output for the reception and transmission of audio signals. In one embodiment, auxiliary port 115*a* may operate as an audio input, while auxiliary port 115*b* may operate as an audio output. In this embodiment, the auxiliary port 115*a* receives audio signals from an external source, such as a vehicle to which the sound bar 100 is mounted, a portable device (i.e., an Apple iPod, MP3 player, smartphone, or similar music playing device), or other sound bar, and transmits those audio signals to the control panel, processor, memory, and any combination thereof. Also, in this embodiment, the auxiliary port 115*b* transmits audio signals from the control panel, processor, memory, and any combination thereof to another sound bar, an audio system of the vehicle to which the sound bar 100 is attached, or a portable device as described above.

Similar to the control panel 110, the speaker assemblies 108 are centered in the middle of the diameter of the tubular housing 102, but each is shifted along the length of the tubular housing 102 proximal to a corresponding one of the woofer speakers capped by an end frame 112. The illustrative speaker assemblies 108 orient the speakers included therein symmetrically along a midline running the length of each speaker assembly 108 with the tweeter speaker 118 located at the middle of both the length and height of the corresponding speaker assembly 108, while the mid-range speakers 116 flank either side of the tweeter speaker 118 and also lie along the lengthwise midline of the speaker assembly 108.

Figure 3:
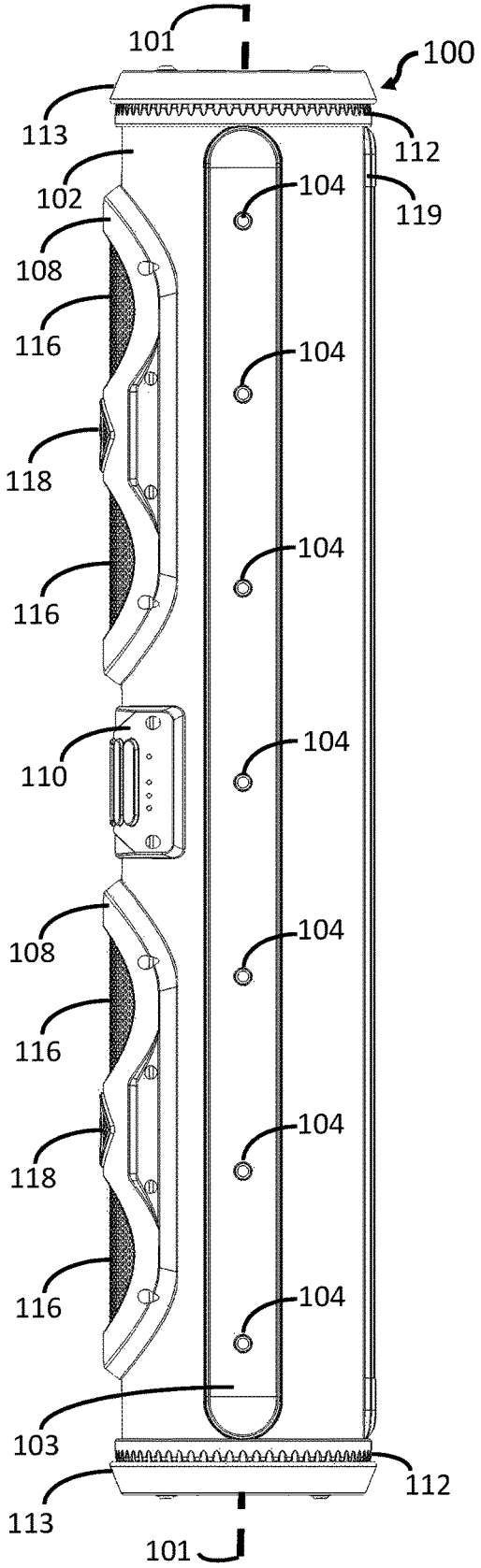
FIG. 3 shows a top view of the illustrative sound bar.

Referring now to FIG. 3, there is shown a top view of the illustrative sound bar 100. This view shows the linearly aligned female threaded holes 104 in the mounting rail 103 running the length of the tubular housing 102 in a position designated as the top of the sound bar 100. This view also shows an LED light bar 119 in profile running linearly along a portion of the tubular housing 102 designated as the rear of the tubular housing 102. As with the other electrically powered components of the sound bar 100, the LED light bar is electrically coupled to, controlled by, and operated from the control panel 110.

Figure 4:
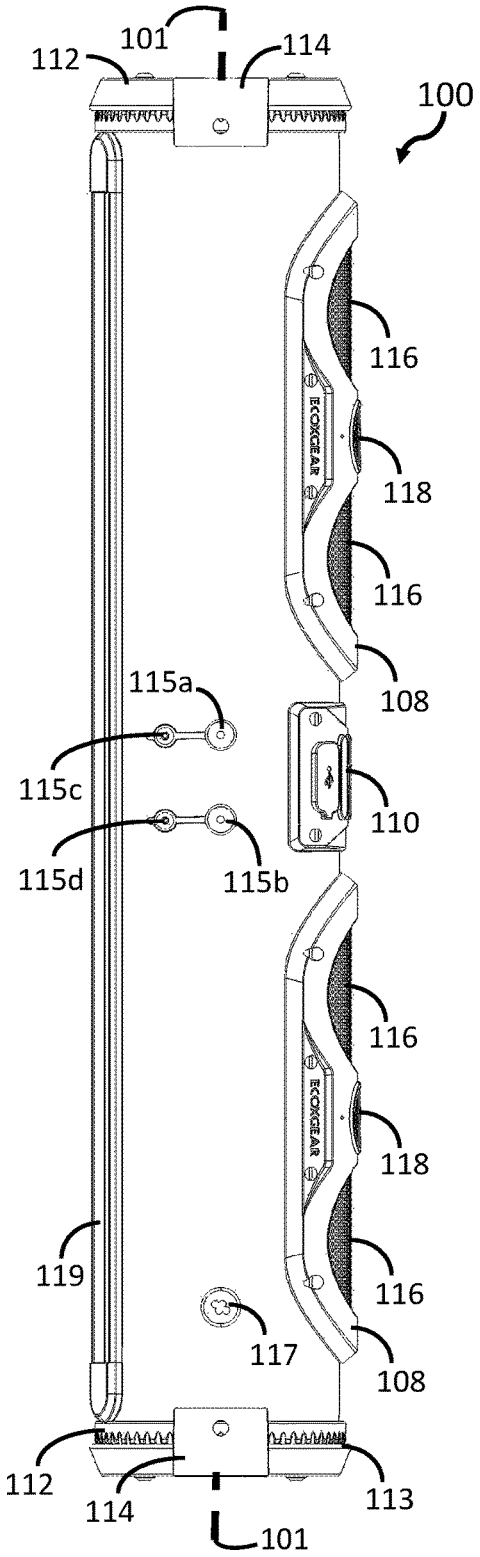
FIG. 4 shows a bottom view of the illustrative sound bar.

Referring now to FIG. 4, there is shown a bottom view of the illustrative sound bar 100. This view displays the wide base of the mounting legs 114 that entirely obscures the narrower stem connecting the base to the rotation cap 113. This view also presents an end on view of the auxiliary ports 115*a-d*. In this embodiment, auxiliary ports 115*a* and 115*b* are auxiliary input ports that receive audio signals, while auxiliary ports 115*c* and 115*d* are auxiliary output ports that transmit audio signals.

Figure 5:
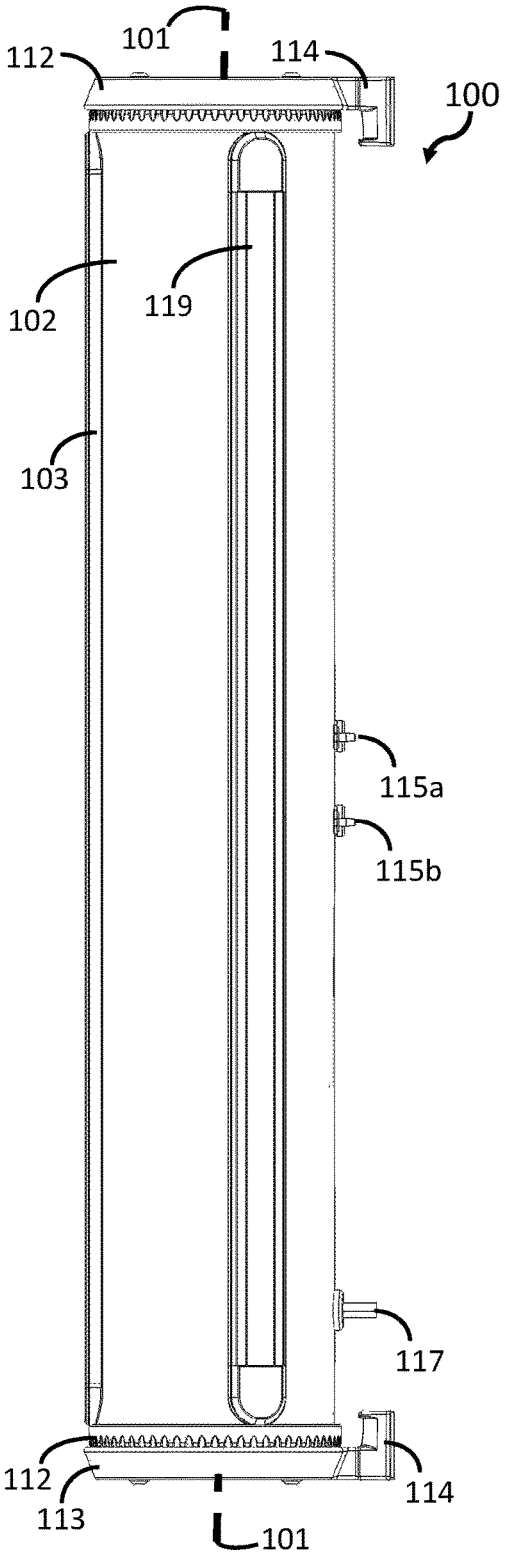
FIG. 5 shows a rear view of the illustrative sound bar.

Referring now to FIG. 5, there is shown a rear view of the illustrative sound bar 100 that displays the mounting legs 114 and their connection to the respective rotation caps 113 in profile. This view also presents the LED light bar 119 from an end on view. In this embodiment, the LED light bar 119 is somewhat below center of the rear side of the tubular housing 102.

Figure 6:
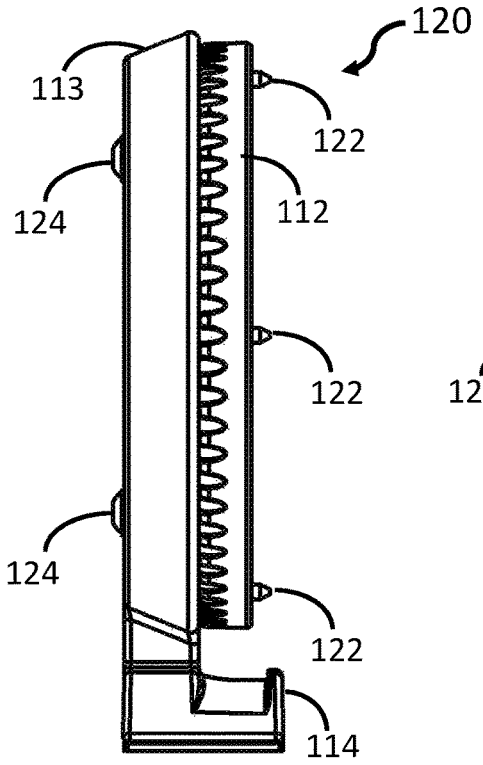
FIG. 6 shows a side view of a woofer speaker cover for the illustrative sound bar.

Referring now to FIG. 6, there is shown a side view of the end cap assembly 120 in isolation from the tubular housing 102. Three of four static fasteners 122 are visible protruding from the inboard side of the end frame 112, while two of four pivot fasteners 124 are visible protruding from the outboard side of the rotation cap 113 that is distal to the tubular housing 102. The static fasteners 122 operate to couple the end frame to the tubular housing 102, and by extension couple the entire end cap assembly 120 to the tubular housing 102. The static fasteners may be screws, pins, and/or rivets that permanently or removably couple the end frame 112 to the tubular housing 102 and cover the woofer speaker within the circular opening at a terminal end of the tubular housing 102. The end frame 112 and static fasteners 122 may secure the woofer speaker in place or simply cover and protect the woofer speaker. The pivot fasteners 124 are screws, pins, and/or rivets that rotatably couple the rotation cap 113 to the end frame 112. When the pivot fasteners 124 are tightened, the rotation cap 113 is secured or locked in place with respect to the end frame 112 and the tubular housing 102. When the pivot fasteners 124 are loosened, the rotation cap 113 is unsecured and may rotate about the lengthwise axis of the sound bar 100 with respect to the rotational position of the end frame 112 and tubular housing 102.

Since the end frame is immovably fixed to the tubular housing 102, when the rotation cap 113 rotates with respect to the end frame 112 it also rotates with respect to the tubular housing 102 and the elements, i.e. speakers, immovably affixed thereto. By affixing the rotation cap 113 to a vehicle or mounting element through the mounting leg 114, the tubular housing 102 may rotate through its connection to the rotation cap 113 with respect to the vehicle.

Figure 7:
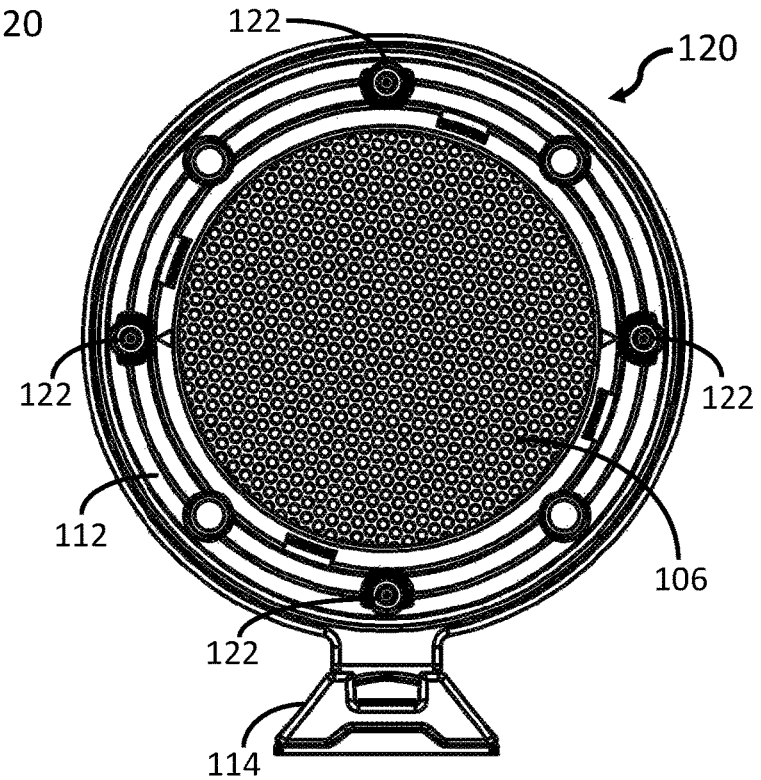
FIG. 7 shows a view of the backside of the woofer speaker cover.

Referring now to FIG. 7, there is shown a view of the inboard side of the end cap assembly 120 in isolation from the tubular housing 102. The inboard side of the end cap assembly 120 is proximal to the tubular housing 102 when assembled together into the sound bar 100. The end frame 112 surrounds the speaker grill 106 and includes eight holes. Four of these holes are occupied by the static fasteners 122, while the other four are empty and capable of receiving the pivot fasteners 124.

Figure 8:
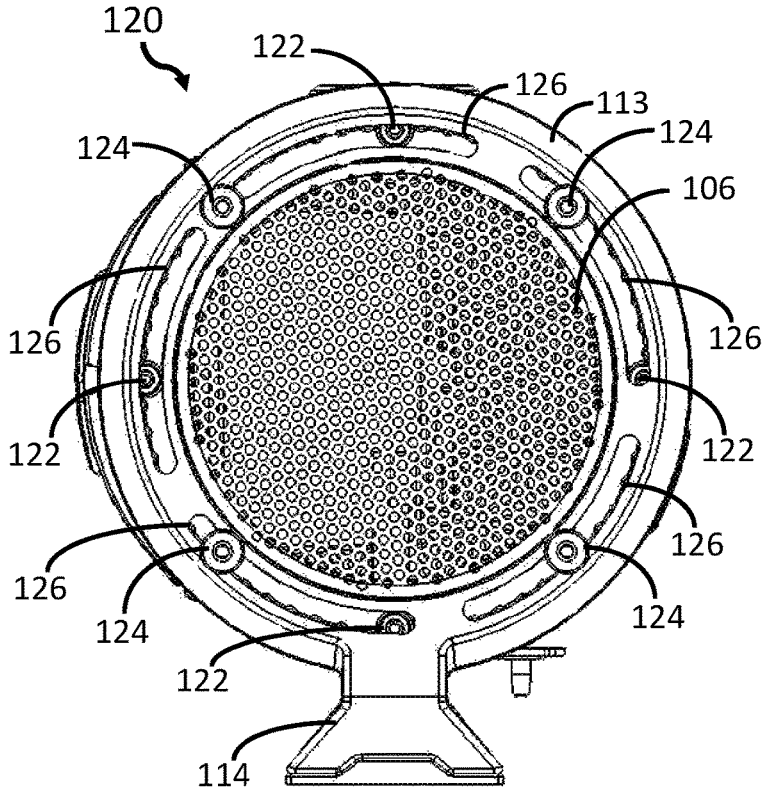
FIG. 8 shows a front view of the woofer speaker cover.

Referring now to FIG. 8, there is shown the end cap assembly 120 viewed from the front side, which is distal to the tubular housing 102. Portions of the static fasteners 122 are visible beneath and behind the rotation cap 113, while the pivot fasteners 124 are clearly visible extending in front of the rotation cap 113. The pivot fasteners 124 extend in front of the rotation cap 113 by passing through slots 126 in the rotation cap 113. These slots 126 both enable rotation of the tubular housing and limit the range of rotation to the angle swept from one end of a slot 126 to the other end of that slot 126. In the illustrative embodiment, four slots 126 are utilized with a small portion of spacing between each slot 126, making the angle swept by one slot slightly less than 90°, and thus the angle of rotation available for the tubular housing 102 also slightly less than 90°. The pivot fasteners 124 include a head or flange that is wider or larger than the width of the slot 126, this construction prevents the rotation cap 113 from dislodging or sliding off of the pivot fasters 124 once the pivot fasteners 124 are coupled to the end frame 112 inboard of the rotation cap 113 and proximal to the tubular housing 102.

Figure 9:
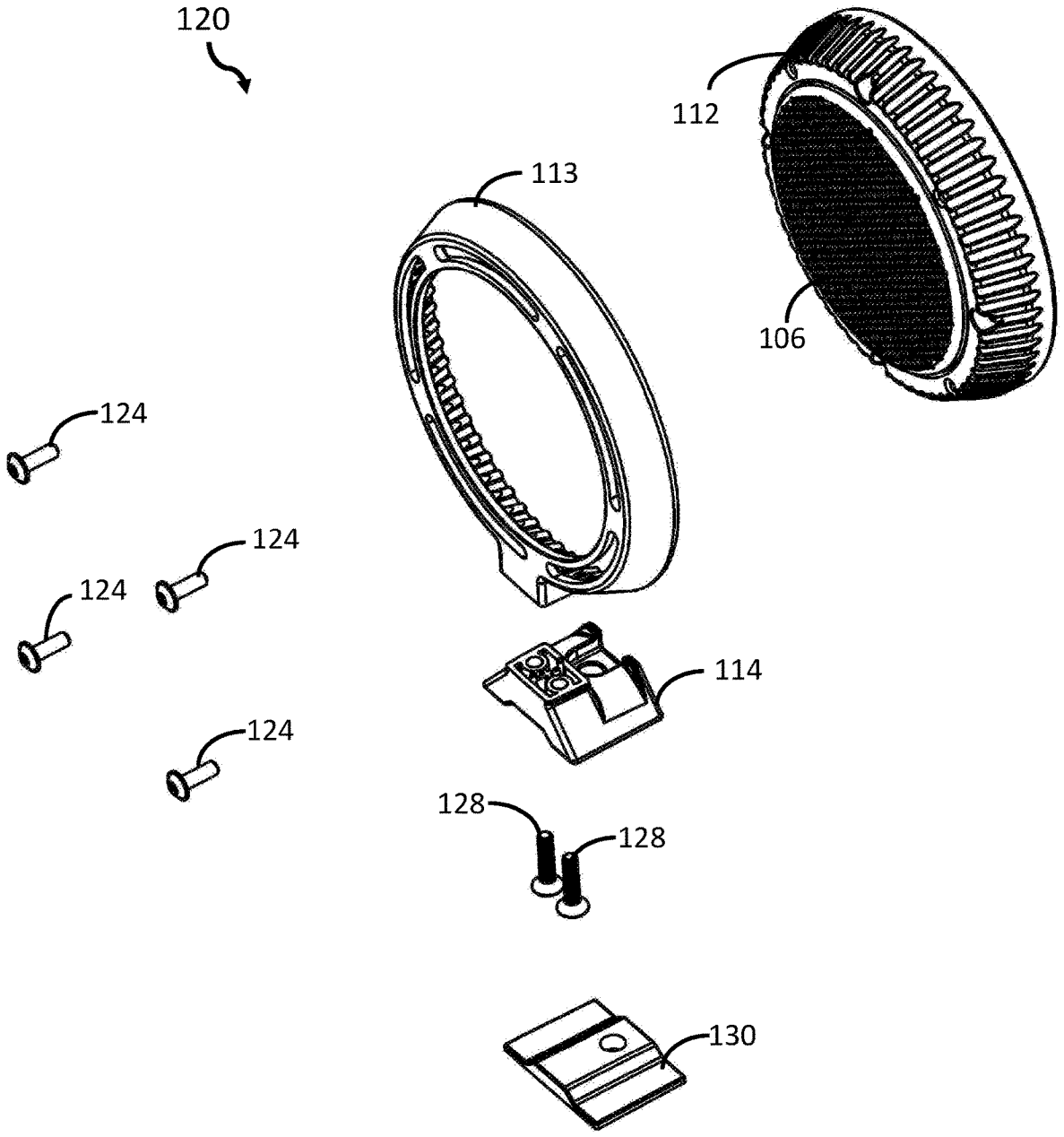
FIG. 9 shows an exploded view of the woofer speaker cover.

Referring now to FIG. 9, there is shown an exploded view of the end cap assembly 120 in isolation from the tubular housing 102. The end frame 112 and the rotation cap 113 both have arcuate planar circumferential surfaces. The outer circumferential surface of the end frame 112 and the inner circumferential surface of the rotation cap 113 are sized and configured to interface with one another when the pivot fasteners 124 are passed through the slots 126 of the rotation cap 113 and coupled to the end frame 112. In the illustrative embodiment, the outer circumferential surface of the end frame 112 is textured with teeth or ridges, and the inner circumferential surface of the rotation cap 113 is textured with corresponding teeth or ridges that interface or interlock with the teeth and/or ridges of the end frame 112. The pivot fasteners 124, slots 126, end frame 112, and rotation cap 113 operate together to allow the sound bar 100 to rotate about its lengthwise axis and be fixed in a rotational position. When the pivot fasteners 124 are loosened or removed entirely from the slots 126, the teeth or ridges of the rotation cap 112 can be disengaged from the teeth or ridges of the end frame so that the tubular housing 102 can rotate freely to a desired rotational position about its lengthwise axis, such as down (e.g., 0°), forward (e.g., 30°-130°), up (e.g., 150°-210°), and backward (e.g., 240°-310°), or any other rotational position. Upon reaching a desired rotational position, the teeth or ridges of the rotation cap 113 may then be re-engaged, interfaced, or interlocked with the teeth or ridges of the end frame 112 by tightening and/or re-inserting the pivot fasteners 124.

The mounting legs 114 include two unthreaded clearance holes, through which two fasteners 128 pass and engage with threaded receiving holes in the bottom of the rotation cap 113. These two fasteners 128 immovably couple the mounting legs to the rotation cap 113. A base plate 130 affixes to the bottom of the mounting leg 114 and thus interfaces with both the mounting leg 114 and the surface of a vehicle and/or receiving mounting element on the vehicle. In some embodiments, the base plate 130 is formed from rubber, silicone, or plastic, and operates to buffer the surface of the vehicle to which the sound bar 100 is attached from the metal of the mounting legs. The base plate 130 thereby prevents the mounting legs from scratching or otherwise marring the vehicle to which it is mounted, while simultaneously increasing the friction between the mounting legs and the vehicle surface and improving the security of the mount.

Referring now to FIG. 10, there is shown a cutaway view of the illustrative sound bar 100 that reveals the internal structure of the tubular housing 102 and the interior passage through the tubular housing 102. The woofer speakers 132*a* and 132*b* received at the terminal openings of the tubular housing cap or form one end of a first isolated sound space 134*a* and a second isolated sound space 134*b* created by the first baffle 136*a* and the second baffle 136*b*. A third isolated sound space 134*c* is located in between the first isolated sound space 134*a* and the second isolated sound space 134*b* associated with woofer speakers 132*a* and 132*b*. The baffles 136*a* and 136*b* fit snugly to the interior surface of the interior passage within the tubular housing 102 and prevent sound waves from passing from one sound space to a neighboring sound space, such as from the second sound space 134*b* to the third sound space 134*c*.

In the illustrative embodiment, the first baffle 136*a* is located inside the tubular hollow housing 102 proximate to the first terminal circular opening housing the first woofer speaker 132*a*, and the second baffle 136*b* is located inside the tubular hollow housing 102 proximate to the second terminal circular opening housing the second woofer speaker 132*b*. Each baffle 136*a* and 136*b* is located somewhere within one half of the interior passage of the tubular housing 102.

Additionally, the first baffle 136*a* is located within the interior passage more proximate to the first woofer speaker 132*a* than the second woofer speaker 132*b*, and thus in the half of the interior passage associated with the first woofer speaker 132*a* and not associated with the second woofer speaker 132*b*. Similarly, the second baffle 136*b* is located within the interior passage more proximate to the second woofer speaker 132*b* than the first woofer speaker 132*a*, and thus in the half of the interior passage associated with the second woofer speaker 132*b* and not associated with the first woofer speaker 132*a*. These restrictions on the placement of the baffles 136*a* and 136*b* create the third isolated sound space 134*c* in between the first baffle 136*a* and the second baffle 136*b*.

The baffles 136*a* and 136*b* may include a dense foam or other rigid/semi-rigid sound deadening or proofing substances that absorb sound waves. The sound spaces 134*a* and 134*b* containing a woofer speaker 132*a* and 132*b*, respectively, and one or more other speakers act as acoustic-suspension boxes or air-suspension boxes that cause back pressure or sound waves generated by their respective speakers to be directed outward from the sound bar 100. The woofer speakers 132*a* and 132*b* are oriented distally along the tubular housing from the baffles 136*a* and 136*b* such that the baffles 136*a* and 136*b* are approximately parallel to the plane the woofer speaker 132*a* and 132*b* lies within. Thus, the sound waves and/or back pressure generated by each woofer speaker 132*a* and 132*b* are directed by the corresponding baffle 136*a* and 136*b* outward from the tubular housing and not internally along the length of the tubular housing 102 between the woofer speakers 132*a* and 132*b*.

Two membrane barriers 138*a* and 138*b* act as one-way waterproof valves that allow high pressure air to escape the interior passage of the tubular housing 102 and prevent water, dirt, or mud from entering from the exterior of the tubular housing 102. These membrane barriers 138*a* and 138*b* may be operatively, fixedly, or otherwise coupled to the tubular hollow housing 102 such that the ports or holes extend from the exterior of the tubular housing 102 into the interior passage and one of the sound spaces created by the baffles 136*a* and 136*b*. Thus, the membrane barriers are coupled with the exterior of the tubular housing 102 on one side of the membrane and coupled with the interior passage on the other side of the membrane.

More or fewer membrane barriers 138*a* and 138*b* may be included on the tubular housing 102. Additionally, the membrane barriers 138*a* and 138*b* may be oriented non-linearly, such as spirally about the tubular housing 102 or oriented asymmetrically to accommodate the location of other features of the sound bar 100, such as the control panel 110 and speaker assemblies 108.

In the illustrative embodiment, the membrane barriers 138*a* and 138*b* cover ports or holes through the tubular housing 102 into the interior passage. The membrane barriers 138*a* and 138*b* may be a waterproof mesh material that allows air to pass through. One exemplary membrane barrier material is expanded polytetrafluoroethylene (ePTFE), especially as prepared by W.L. Gore & Associates, Inc. The ePTFE membrane material is a three-dimensional expansion of the linear base polymer PTFE that has a porous structure. In alternative embodiments, the waterproof valves that may be mechanical one-way valves are employed instead of the membrane barriers. These waterproof valves would similarly allow high pressure air to escape the interior passage of the tubular housing 102 and prevent water, dirt, or mud from entering from the exterior of the tubular housing 102.

The primary purpose of the membrane barriers 138*a* and 138*b* is to prevent a pressure differential from building up between the tubular housing interior and the exterior due to heat generated by the operation of the speakers and the extreme environments in which the sound bar 100 operates, i.e. high air temperature and direct sunlight, or freezing temperatures. By allowing air to pass through the membrane barriers 138*a* and 138*b*, the membrane barriers 138*a* and 138*b* act to conduct heat into or out of the tubular housing interior. Back pressure generated by each speaker may also escape through the membrane barriers 138*a* and 138*b*.

The membrane barriers 138*a* and 138*b* also prevent pressure from accumulating within the acoustic-suspension boxes that are the two spaces for the various speakers, otherwise the pressure may accumulate until it is sufficient to dislodge one or more of the speakers. Should a speaker be dislodged in this manner, it would decrease the sound quality produced by the sound bar 100 by adding unintended vibrations from the dislodged speaker or from water that has seeped into the associated sound space. Further, water seeping through a dislodged element into the interior of the tubular housing may degrade or short-out internal electrical connections between the speakers and the control panel 110 or enter the sound space 134*c* housing the control panel 110 itself. Water seeping into the sound space 134*c* corrode and/or short any of the control panel connections or elements, such as the auxiliary ports 115*a* and 115*b* that are enter into, or are housed within, the sound space 134*c*. Such water damage would shorten the operable life span of the sound bar 100 or disable it entirely. However, the membrane barriers 138*a* and 138*b* prevent such degradation of the sound bar 100 and extend its operable life span.

In operation, the sound bar 100 emits sound waves from each speaker, i.e. the woofer speakers 132*a* and 132*b*, tweeter speakers, and mid-range speakers, according to input received from the control panel 110. The input may be the result of a user pressing one or more of the buttons on the control panel or from a music uploaded, input, or otherwise present upon the processor of the sound bar 100. In the illustrative embodiment, each woofer speaker 132*a* and 132*b* is located in one terminal circular opening of the tubular housing 102 and emits sound waves outward from the terminal circular opening along the central lengthwise axis 101 of the tubular housing 102, while simultaneously emitting sound waves and/or back pressure into their corresponding sound space also along the central lengthwise axis 101 to a corresponding internal baffle 136*a* and 136*b*. Each baffle 136*a* and 136*b* absorbs the sound waves and/or back pressure emitted by the woofer speaker 132*a* and 132*b* located in the terminal circular opening proximate to that baffle 136*a* and 136*b*.

In an illustrative embodiment, the first woofer speaker 132*a* emits sound waves out of the sound bar 100 along the central lengthwise axis 101 while also emitting sound waves and/or back pressure into the first isolated sound space 134*a* along the central lengthwise axis 101 toward and into the first baffle 136*a*. Similarly, the second woofer speaker 132*b* emits sound waves out of the sound bar 100 along the central lengthwise axis 101 while also emitting sound waves and/or back pressure into the second isolated sound space 134*b* along the central lengthwise axis 101 toward and into the second baffle 136*b*. While both woofer speakers 132*a* and 132*b* emit sound waves into and out of the interior passage of the tubular housing 102, the woofer speakers 132*a* and 132*b* face opposite directions. Thus, the first woofer speaker 132*a* faces a first direction and emits sound waves out of the tubular hollow housing 102 in that first direction, while emitting back pressure in a second direction into the interior passage and first isolated sound space 134*a*. Similarly, the second woofer speaker 132*b* faces the second direction and emits sound waves out of the tubular hollow housing 102 in that second direction, while emitting back pressure in the first direction into the interior passage and second isolated sound space 134*b*.

Additionally, the mid-range speakers and tweeter speakers of the speaker assemblies 108 emit sound waves outward from the tubular housing 102 and perpendicular to the central lengthwise axis of the tubular housing 102, while simultaneously emitting sound waves and/or back pressure in an opposite direction inward into the interior of the tubular housing 102. As with the sound waves and/or back pressure of the woofer speakers 132*a* and 132*b*, the baffle 136*a* and 136*b* isolating and creating the acoustic suspension box or sound space into which the mid-range and tweeter speakers emit sound waves and/or back pressures absorbs at least a portion of those sound waves and/or back pressures even though they are emitted parallel and adjacent to the baffle 136*a* and 136*b* instead of directly at the baffle 136*a* and 136*b* as with the woofer speaker sound waves and/or back pressures. At the same time, although not necessarily so, the membrane barriers 138*a* and 138*b* equalize the internal pressure present within the interior of the tubular housing 102 with the external pressure surrounding the tubular hollow housing 102, such as the ambient environmental air pressure and temperature outside the sound bar 100, by allowing air to pass into or out of the interior of the tubular housing 102 through the membrane barrier without allowing water, dirt, or other debris to enter the tubular housing interior.

User commands input at the control panel 110 may also control the operation of the LED lights resident within each speaker of the sound bar 100 and the LED light bar 103 mounted on the exterior of the tubular housing 102. However, the operation of the various LED lights may be automated in conjunction with music played by the sound bar 100 and require no specific input from a user.

It is to be understood that the detailed description of illustrative embodiments are provided for illustrative purposes. The scope of the claims is not limited to these specific embodiments or examples. Therefore, various process limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A sound bar for attachment to a vehicle comprising:

a tubular hollow housing including a first terminal circular opening, a second terminal circular opening, an interior passage extending from the first terminal circular opening to the second terminal circular opening, and a tubular surface extending from the first terminal circular opening to the second terminal circular opening and surrounding the interior passage, wherein the tubular surface includes a first speaker assembly opening extending from the tubular surface to the interior passage, a second speaker assembly opening extending from the tubular surface to the interior passage, and a plurality of membranes coupled with the tubular surface and the interior passage;

each of the plurality of membranes comprise a waterproof mesh material spanning a port extending from the surface of the tubular housing to the interior passage, wherein the waterproof mesh material allows the passage of air there through;

the first terminal circular opening receives a first woofer speaker;

the second terminal circular opening receives a second woofer speaker;

the first speaker assembly opening receives a first speaker assembly;

the second speaker assembly opening receives a second speaker assembly;

a first baffle inside the tubular hollow housing proximate to the first terminal circular opening;

a second baffle inside the tubular hollow housing proximate to the second terminal circular opening; and wherein the first baffle and the second baffle separate the interior passage of the tubular hollow housing into a first internal sound space including the first woofer speaker and the first speaker assembly, a second internal sound space including the second woofer and the second speaker assembly, and a third internal sound space that is located in between the first internal sound space and the second internal sound space, wherein the third internal sound space includes a control panel communicatively coupled to each of the first woofer speaker, the second woofer speaker, the first speaker assembly, and the second speaker assembly.

2. The sound bar of claim 1 further comprising:

a mounting inlay affixed to the tubular hollow housing;

a first mounting bracket affixed to the mounting inlay at a location proximate to the first terminal circular opening, wherein the first mounting bracket includes a first pivot attach point centered on a central lengthwise axis of the tubular hollow housing; and a second mounting bracket affixed to the mounting inlay at a location proximate to the second terminal circular opening, wherein the second mounting bracket includes a second pivot attach point centered on the central lengthwise axis of the tubular hollow housing.

3. The sound bar of claim 1 wherein:

the first speaker assembly comprises a first mid-range speaker, a second mid-range speaker, and a first tweeter speaker; and the second speaker assembly comprising a third mid-range speaker, a fourth mid-range speaker, and a second tweeter speaker.

4. The sound bar of claim 1 wherein each of the first baffle and the second baffle comprise a dense foam that absorbs sound waves.

5. The sound bar of claim 1 wherein the first speaker assembly opening is proximate to the first terminal circular opening of the tubular hollow housing, the second speaker assembly opening is proximate to the second terminal circular opening of the tubular hollow housing, and the first speaker assembly opening and the second speaker assembly opening are aligned linearly along the tubular surface of the tubular hollow housing.

6. The sound bar of claim 1 wherein each of the first woofer speaker, the second woofer speaker, and each speaker of the first speaker assembly and the second speaker assembly include a clear waterproof speaker driver cone and a light emitting diode (LED).

7. A method of producing sound with a sound bar comprising:

emitting, by a first woofer speaker, first woofer speaker sound waves along a central lengthwise axis of a tubular hollow housing of the sound bar distally outward from a first terminal circular opening of the tubular hollow housing in a first direction and proximally into an interior passage of the tubular hollow housing in a second direction, wherein the tubular hollow housing includes the first terminal circular opening, a second terminal circular opening, an interior passage extending from the first terminal circular opening to the second terminal circular opening, a tubular surface extending from the first terminal circular opening to the second terminal circular opening and surrounding the interior passage, and a plurality of membranes coupled with the tubular surface and the interior passage, wherein each of the plurality of membranes comprise a waterproof mesh material spanning a port extending from the surface of the tubular housing to the interior passage;

emitting, by a second woofer speaker, second woofer speaker sound waves along the central lengthwise axis of the tubular hollow housing distally outward from the second terminal circular opening of the tubular hollow housing in the second direction and proximally into the interior passage of the tubular hollow housing in the first direction;

absorbing, by a first baffle, the first woofer speaker sound waves emitted proximally into the interior passage of the tubular hollow housing in the second direction, wherein the first baffle located inside the tubular hollow housing proximate to the first terminal circular opening of the tubular hollow housing;

absorbing, by a second baffle, the second woofer speaker sound waves emitted proximally into the interior passage of the tubular hollow housing in the first direction, wherein the second baffle located inside the tubular hollow housing proximate to the second terminal circular opening of the tubular hollow housing;

wherein the first baffle and the second baffle separate the interior passage of the tubular hollow housing into a first internal sound space including the first woofer speaker, a second internal sound space including the second woofer, and a third internal sound space that is located in between the first internal sound space and the second internal sound space;

isolating, by the first baffle and the second baffle, a control panel from the first internal sound space and the second internal sound space; and equalizing, by each of the plurality of membranes, an internal pressure of the tubular hollow housing with an external pressure surrounding the tubular hollow housing.

8. The method of claim 7 further comprising:

emitting, by at least one speaker of a first speaker assembly, first speaker assembly sound waves perpendicular to the central lengthwise axis of the tubular hollow housing laterally outward from a first speaker assembly opening extending from the tubular surface to the interior passage in a third direction and medially into the interior passage of the tubular hollow housing in a fourth direction, wherein the first speaker assembly opening located proximal to the first terminal circular opening of the tubular hollow housing;

absorbing, by the first baffle, the first speaker assembly sound waves emitted medially into the interior passage of the tubular hollow housing;

emitting, by at least one speaker of a second speaker assembly, second speaker assembly sound waves perpendicular to the central lengthwise axis of the tubular hollow housing laterally outward from a second speaker assembly opening extending from the tubular surface to the interior passage in the third direction and medially into the interior passage of the tubular hollow housing in the fourth direction, wherein the second speaker assembly opening located proximal to the second terminal circular opening of the tubular hollow housing; and absorbing, by the second baffle, the second speaker assembly sound waves emitted medially into the interior passage of the tubular hollow housing.

9. The method of claim 7 further comprising:

affixing a mounting inlay to the tubular hollow housing;

affixing a first mounting bracket to the mounting inlay at a location proximate to the first terminal circular opening, wherein the first mounting bracket includes a first pivot attach point centered on the central lengthwise axis of the tubular hollow housing; and affixing a second mounting bracket to the mounting inlay at a location proximate to the second terminal circular opening, wherein the second mounting bracket includes a second pivot attach point centered on the central lengthwise axis of the tubular hollow housing.

10. The method of claim 9 further comprising:

rotatably affixing the first pivot attach point to a first mounting element; rotatably affixing the second pivot attach point to a second mounting element; rotating the sound bar about the first pivot attach point and the second pivot attach point; and wherein the first mounting element and the second mounting element affixed to one of a vehicle and an outdoor structure.

11. The method of claim 7 wherein:

the first speaker assembly comprises a first mid-range speaker, a second mid-range speaker, and a first tweeter speaker; and the second speaker assembly comprising a third mid-range speaker, a fourth mid-range speaker, and a second tweeter speaker.

12. The method of claim 7 wherein each of the first baffle and the second baffle comprise a dense foam that absorbs sound waves.

13. The method of claim 7 further comprising:

controlling, by a control panel communicatively coupled to each of the first woofer speaker, the second woofer speaker, the first speaker assembly, and the second speaker assembly, at least one of volume and power for each of the first woofer speaker, the second woofer speaker, the first speaker assembly, and the second speaker assembly.

14. The method of claim 7 wherein each of the first woofer speaker, the second woofer speaker, and each speaker of the first speaker assembly and the second speaker assembly include a clear waterproof speaker driver cone and a light emitting diode (LED).

15. The method of claim 14 further comprising:

controlling, by a control panel communicatively coupled to each of the first woofer speaker, the second woofer speaker, the first speaker assembly, and the second speaker assembly, at least one of volume, lighting, and power for each of the first woofer speaker, the second woofer speaker, the first speaker assembly, and the second speaker assembly.

* * * * *